US007461622B2

(12) United States Patent
Maemura et al.

(10) Patent No.: US 7,461,622 B2
(45) Date of Patent: Dec. 9, 2008

(54) CONTROLLER FOR A DIRECT-INJECTION INTERNAL COMBUSTION ENGINE AND METHOD OF CONTROLLING THE DIRECT-INJECTION INTERNAL COMBUSTION ENGINE

(75) Inventors: Jun Maemura, Aichi-ken (JP); Seiji Hirowatari, Toyota (JP); Masahiko Teraoka, Toyota (JP); Takeyasu Muraishi, Hamamatsu (JP)

(73) Assignees: Toyota Jidosha Kabushiki Kaisha, Toyota (JP); Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 11/491,151

(22) Filed: Jul. 24, 2006

(65) Prior Publication Data

US 2007/0023007 A1 Feb. 1, 2007

(30) Foreign Application Priority Data

Jul. 26, 2005 (JP) ..... 2005-215440

(51) Int. Cl.
*F02D 43/00* (2006.01)
*F02P 9/00* (2006.01)
*F02N 17/00* (2006.01)

(52) U.S. Cl. ..... 123/179.5; 123/305

(58) Field of Classification Search ..... 123/179.3, 123/179.5, 406.53, 406.55, 305
See application file for complete search history.

(56) References Cited

U.S. PATENT DOCUMENTS

2002/0174853 A1 11/2002 Suzuki et al.
2007/0012295 A1* 1/2007 Maemura et al. ..... 123/491

FOREIGN PATENT DOCUMENTS

| | | |
|---|---|---|
| JP | A 63-189628 | 8/1988 |
| JP | A 2-119648 | 5/1990 |
| JP | A 5-214986 | 8/1993 |
| JP | A 5-296084 | 11/1993 |
| JP | A 7-42585 | 2/1995 |
| JP | A 10-9004 | 1/1998 |
| JP | A 11-270387 | 10/1999 |
| JP | A 2000-97071 | 4/2000 |
| JP | A 2002-332893 | 11/2002 |
| JP | 2005-155434 A * | 6/2005 |
| JP | 2006-183510 A * | 7/2006 |

* cited by examiner

*Primary Examiner*—Stephen K Cronin
*Assistant Examiner*—Ka Chun Leung
(74) *Attorney, Agent, or Firm*—Oliff & Berridge, PLC

(57) ABSTRACT

A controller for a direct-injection internal combustion engine in which fuel is directly injected into a combustion chamber via a fuel injection valve, and a mixture formed thereby is burned by igniting the mixture via an ignition plug, which the controller, when the internal combustion engine is started under very low temperature conditions, controls an ignition cut operation that inhibits ignition and performs fuel injection only, the controller including an engine-start control unit that, when the internal combustion engine is started under very low temperature conditions after the ignition cut operation was performed, determines whether there is fuel that can contribute to combustion in a cylinder and if there is, inhibits the ignition cut operation, or limits a number of times of the cutting off of ignition.

20 Claims, 7 Drawing Sheets

CONTROLLER FOR A DIRECT-INJECTION INTERNAL COMBUSTION ENGINE AND METHOD OF CONTROLLING THE DIRECT-INJECTION INTERNAL COMBUSTION ENGINE

INCORPORATION BY REFERENCE

The disclosure of Japanese Patent Application No. 2005-215440 filed on Jul. 26, 2005 including the specification, drawings and abstract is incorporated herein by reference in its entirety.

BACKGROUND OF THE INVENTION

1. Field of the Invention

The present invention relates to a controller for a direct-injection internal combustion engine to be mounted on a vehicle or the like and a method of controlling the direct-injection internal combustion engine. More specifically, the present invention relates to a controller for a direct-injection internal combustion engine and a method of controlling the direct-injection internal combustion engine that, when the internal combustion engine is started under very low temperature conditions, control the ignition cut operation in which ignition of a mixture in a combustion chamber performed by the ignition plug is interrupted.

2. Description of the Related Art

In a direct-injection internal combustion engine (hereinafter also referred to as the direct-injection engine), a fuel injection valve (injector) is provided for each cylinder. The fuel, such as gasoline, is directly injected into combustion chambers via the fuel injection valves, and mixed with intake air introduced from inlet ports into the combustion chambers to form a mixture, which is ignited by ignition plugs. The direct-injection engine is excellent because of low fuel consumption, low emission and high power output. For this reason, the demand for the engine is rapidly increasing.

However, in the direct-injection engine, the time period from when the fuel is injected to when the fuel reaches the ignition point is short as compared to that of a port-injection engine that injects the fuel into the inlet port. For this reason, when the engine is started at a very low temperature (below −25° C., for example), atomization of the fuel injected into the cylinders becomes insufficient. As a result, ensured ignition cannot be achieved, and the startability becomes unstable.

As a measure against such a problem that arises when the engine is started under very low temperature conditions, there is engine-start control in which, when cranking is performed at the time of engine startup, the ignition cut operation is performed that inhibits ignition and performs fuel injection only, and in which, after the ignition cut operation is finished, both of fuel injection and ignition are performed (see Japanese Patent Application Publication No. JP-A-2000-097071, for example). If such the ignition cut operation is performed, part of the fuel injected during the ignition cut operation remains in the cylinders even after an exhaust stroke. Accordingly, by the time when the first ignition is initiated after the ignition cutoff period has elapsed, the fuel remaining in the cylinder atomizes. As a result, ignition is ensured.

As a technology concerning the ignition cut operation at the time of engine startup, there is a technology for optimizing the length of the ignition cutoff period depending on the engine temperature measured at the time of engine startup, by setting the period of time required for the fuel to atomize as the ignition cutoff period at an early stage of engine startup, based on the coolant temperature (see Japanese Patent Application Publication No. JP-A-11-270387, for example).

With regard to the direct-injection internal combustion engines that perform the ignition cut operation, in some cases, after the engine is stopped immediately after the engine is started under very low temperature conditions, it becomes difficult to start the engine when it is attempted to restart the engine with ignition cutoff performed. For example, when the inside of the cylinders is warmed up after the engine is started under very low temperature conditions, the fuel that can contribute to combustion increases because, in the state where the inside of the cylinder has been warmed up, the fuel injected when the engine is restarted is warmed up due to the temperature in the cylinders. Under such conditions, if the ignition cut operation is performed when the engine is restarted after the engine is stopped (when the engine is restarted in a state where the inside of the cylinders has been warmed up), there is the fuel that can be effectively used in the cylinder, and, on the top of that, the fuel provided during the ignition cut operation is added in the cylinders. Accordingly, the fuel condition becomes over-rich, and "wetting of ignition plugs" and/or "smoldering of ignition plugs" are caused. As a result, it becomes difficult to start the engine. It should be noted that the state where the inside of the cylinders has been warmed up does not mean a state where the engine has been warmed up to the extent that the coolant temperature becomes 80° C. or more (the engine has been completely warmed up), for example, but means a state where the inside of the cylinders has been warmed up to the extent that the fuel becomes easy to atomize.

When the engine is started under very low temperature conditions, if the engine is stopped (cranking is stopped) during the ignition cut operation, or if the engine is stopped before the fuel has been completely burned, it can become difficult to start the engine when the engine is restarted after the engine is stopped as described above. That is, if the engine is stopped during the ignition cut operation, the fuel injections into the cylinders corresponding to the number of times of ignition cut operation performed by the time when the engine is stopped, have been performed. If, thereafter, the ignition cut operation is performed a predetermined number of times at the time of restart, in addition to the injection performed during the ignition cut operation last time, the fuel injection is further performed during the ignition cut operation performed this time. Also in this case, the fuel condition becomes over-rich, and it can become difficult to start the engine.

With regard to 6-cylinder engines, for example, in the case where the requested number of times of ignition cut operation is twelve, if, during the ignition cut operation at the time of engine startup under very low temperature conditions, the engine is stopped at the time when the ignition cut operation has been performed nine times, and if the ignition cut operation is performed twelve times at the time of restart (at the time of startup under very low temperature conditions), the total number of times the fuel is injected during the ignition cut operation is 21. Accordingly, "wetting of ignition plugs" and/or "smoldering of ignition plugs" can occur due to the over-rich fuel condition.

The problem of the over-rich fuel condition caused when the engine is restarted under very low temperature conditions while the inside of the cylinders is in a warmed-up state, or when the engine is restarted under very low temperature conditions after the engine is stopped during the ignition cut operation, is not considered in Japanese Patent Application Publication No. JP-A-11-270387 cited above. The above-described problems cannot be solved by the method described in Japanese Patent Application Publication No.

JP-A-11-270387, that is, the method in which the period of time required to atomize the fuel is set as the ignition cutoff period at an early stage of startup, based on the coolant temperature, with attention being focused only on the time required for the injected fuel to atomize.

SUMMARY OF THE INVENTION

A first aspect of the present invention is a controller for a direct-injection internal combustion engine in which fuel is directly injected into a combustion chamber via a fuel injection valve, and a mixture formed thereby is burned by igniting the mixture via an ignition plug, which controller, when the internal combustion engine is started under very low temperature conditions, controls the ignition cut operation in which ignition performed by the ignition plug is interrupted, the controller including: an engine-start control device that, when the internal combustion engine is started under very low temperature conditions, determines whether there is fuel that can contribute to combustion in a cylinder, and, if there is fuel that can contribute to combustion, inhibits the cutting off of ignition, or limits the number of times of the cutting off of ignition.

Such a configuration improves startability under very low temperature conditions. Specifically, when the engine is restarted under very low temperature conditions while the inside of the cylinders is in a warmed-up state, or when the engine is restarted under very low temperature conditions after the engine is stopped during the ignition cut operation, the over-rich fuel condition is avoided by inhibiting or limiting the fuel injection during the ignition cut operation at the time of engine startup under very low temperature conditions; this is because there is the fuel that can contribute to combustion in the cylinder. Thus, "wetting of ignition plugs" and/or "smoldering of ignition plugs" are inhibited.

Specific features in the first aspect of the present invention will be described below.

With regard to the first aspect of the present invention, as a method of determining whether there is fuel that can contribute to combustion in the cylinder when the internal combustion engine is started under very low temperature conditions, a method in which, when the internal combustion engine is started under very low temperature conditions, it is determined whether there is a cylinder-inside warming-up history. If, as a result of this determination, it is found that there is the cylinder-inside warming-up history, it is determined that there is fuel that can contribute to combustion in the cylinder, and the ignition cut operation is inhibited. If the ignition cut operation is inhibited according to the result of determining whether there is the cylinder-inside warming-up history, the over-rich fuel condition caused when the engine is restarted under very low temperature conditions while the inside of the cylinders is in a warmed-up state, is avoided.

As a specific example of engine-start control using the cylinder-inside warming-up history, control is cited in which, when elapsed time since start of the internal combustion engine under very low temperature conditions becomes equal to or longer than a predetermined period of time, or when a total amount of intake air since start of the internal combustion engine under very low temperature conditions becomes equal to or greater than a predetermined amount, it is determined that there is the cylinder-inside warming-up history; unless a predetermined cancellation condition is satisfied when there is the cylinder-inside warming-up history, the ignition cut operation is inhibited.

Even if the inside of the cylinder is warmed up, when a certain period of time has elapsed after the engine is stopped, and the inside of the cylinder is thus cooled, it is necessary to perform fuel injection during the ignition cut operation at the time of engine startup under very low temperature conditions. In order to realize this, it is necessary to set a condition for canceling the inhibition of cutting off of ignition. The cancellation condition is one of following conditions: a coolant temperature measured when the internal combustion engine is started under very low temperature conditions is lower than a coolant temperature measured when the internal combustion engine was stopped last time; and the coolant temperature measured when the internal combustion engine is started under very low temperature conditions is higher by a predetermined value or more than a coolant temperature measured when the internal combustion engine was stopped last time. When one of the conditions is satisfied, the inhibition of the ignition cut operation is cancelled.

The condition, "the coolant temperature measured when the internal combustion engine is started under very low temperature conditions is higher by a predetermined value or more than a coolant temperature measured when the internal combustion engine was stopped last time," is set to identify the situation in which the coolant temperature measured at the time of engine startup is higher than the temperature measured when the engine was stopped last time due to the influence of the ambient temperature during the soak time. For example, this is the situation in which the coolant temperature measured when the engine is stopped last time is −30° C., and the engine is started in the next morning when the coolant temperature is −25° C. because the ambient temperature measured at the time of engine startup in the next morning is higher than that measured on the preceding day.

If a soak timer for measuring the soak time is installed, the cancellation condition may be that a soak time which has been elapsed by the time when the internal combustion engine is started under very low temperature conditions is equal to or longer than a predetermined period of time (the time required for the inside of the cylinder to cool down). When the condition is satisfied, the inhibition of the ignition cut operation is cancelled.

In the first aspect of the present invention, as another method of determining whether there is fuel that can contribute to combustion in the cylinder when the internal combustion engine is started under very low temperature conditions, a method is cited in which, when the internal combustion engine is started under very low temperature conditions, it is determined whether there is a fuel-injection history during the ignition cut operation. If there is the fuel-injection history during the ignition cut operation, it is determined that there is fuel that can contribute to combustion in the cylinder, and the number of times of the ignition cut operation is limited, or the ignition cut operation is inhibited. If, according to the result of determining whether there is the fuel-injection history, the number of times of the ignition cut operation is limited, or the ignition cut operation is inhibited, the over-rich fuel condition caused when the engine is restarted under very low temperature conditions after the engine is stopped during the ignition cut operation, is avoided.

Specifically, when the internal combustion engine is started (or restarted) under very low temperature conditions, if there is the fuel-injection history during the ignition cut operation, a current number of times the ignition cut operation is to be performed is calculated, using the requested number of times of the ignition cut operation based on a coolant temperature of the internal combustion engine and using the recorded number of times of fuel injection during the ignition cut operation that was performed when it was attempted to start the engine last time. If the calculated value of the number of times the ignition cut operation is to be performed is equal to or greater than one, the ignition cut operation is performed based on the calculated value. If the calculated value of the number of times the ignition cut operation is to be performed is equal to zero, the ignition cut operation is not performed. In this way, the over-rich fuel condition is avoided when the engine is restarted under very low temperature conditions after the engine is stopped during the ignition cut operation.

When the ignition cut operation is performed based on the calculated value of the number of times the ignition cut operation is to be performed, it is determined whether there is the cylinder for which the ignition cut operation is to be performed more times than the requested number of times of the ignition cut operation per cylinder. If the ignition cut operation is not performed for the cylinder for which the ignition cut operation is to be performed more times than the requested number of times of the ignition cut operation per cylinder, it is possible to avoid the over-rich fuel condition for each cylinder.

When, after the engine is started under very low temperature conditions, the engine speed is increased, and the engine has been warmed up, the fuel that was adhering to the top surface of the piston, for example, at a low temperature is burned, and completely consumed. Under such conditions, it is necessary to perform fuel injection while ignition is cut off maximum times (which corresponds to the requested number of times of cutting off of ignition). In order to realize this, when elapsed time since start of the internal combustion engine under very low temperature conditions becomes equal to or longer than a predetermined period of time, or when a total amount of intake air since start of the internal combustion engine under very low temperature conditions becomes equal to or greater than a predetermined amount, the recorded number of times of fuel injection in the fuel-injection history during the ignition cut operation is reset to zero, and ignition is cut off maximum times (which corresponds to the requested number of times of cutting off of ignition).

With regard to a direct-injection gasoline engine provided with a VVT (Variable Valve Timing) mechanism, in some cases, in order to inhibit the exhaust gas from containing soot when the engine is started under very low temperature conditions, control is performed in which valve timing of air intake valves is maximally advanced via the VVT mechanism to introduce a large quantity of internal EGR gas into the combustion chamber. As in the above case, when such control is performed, the fuel that was adhering to the top surface of the piston, for example, at a low temperature is completely consumed, the recorded number of times of fuel injection in the fuel-injection history during the ignition cut operation is reset to zero, and the ignition cut operation is performed maximum times (which corresponds to the calculated value of the requested number of times of cutting off of ignition).

When the internal combustion engine is started under very low temperature conditions, if the soak time is equal to or longer than a period of time required for the fuel in the cylinder to vaporize, the fuel that can contribute to combustion in the cylinder is completely consumed. Accordingly, also in this case, the ignition cut operation is performed maximum times (which corresponds to the calculated value of the requested number of times of cutting off of ignition).

A second aspect of the present invention is a method of controlling a direct-injection internal combustion engine in which fuel is directly injected into a combustion chamber via a fuel injection valve, and a mixture formed thereby is burned by igniting the mixture via an ignition plug, which method, when the internal combustion engine is started under very low temperature conditions, controls the ignition cut operation in which ignition performed by the ignition plug is interrupted, the method including: determining whether there is fuel that can contribute to combustion in a cylinder when the internal combustion engine is started under very low temperature conditions; and, if there is fuel that can contribute to combustion, inhibiting the cutting off of ignition, or limiting a number of times of the cutting off of ignition.

According to the aspects of the present invention, in engine-start control in which the ignition cut operation of direct-injection internal combustion engine is controlled when the engine is started under very low temperature conditions, it is determined whether there is the fuel that can contribute to combustion in the cylinder, at the time of engine startup under very low temperature conditions. If there is the fuel that can contribute to combustion, the ignition cut operation is inhibited, or the number of times of the ignition cut operation is limited. Accordingly, the over-rich fuel condition caused when the engine is restarted under very low temperature conditions while the inside of the cylinders is in a warmed-up state, or when the engine is restarted under very low temperature conditions after the engine is stopped during the ignition cut operation, is avoided. Thus, the startability under very low temperature conditions is improved.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

Description will be given below of an embodiment of the present invention with reference to the drawings.

First, an engine (internal combustion engine) to which the present invention is applied will be described.

Engine

Figure 1:
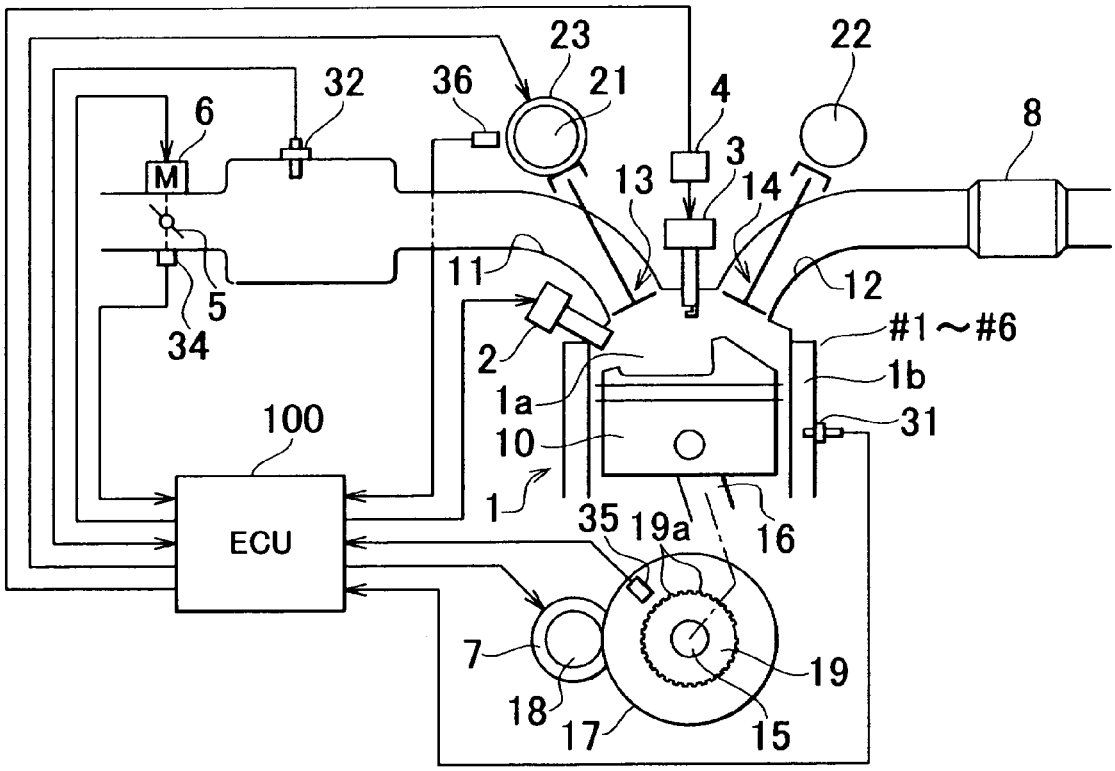
FIG. 1 is a schematic configuration diagram showing an example of a direct-injection engine to which the present invention is applied.

FIG. 1 is a diagram showing a schematic configuration of the engine to which the present invention is applied. In FIG. 1, a configuration of one cylinder of the engine is illustrated.

The engine 1, which is a direct-injection 6-cylinder gasoline engine having six cylinders (cylinders #1 to #6), includes pistons 10, each of which defines a combustion chamber 1*a*, and a crankshaft 15, which is an output shaft. The pistons 10 are connected to the crankshaft 15 via connecting rods 16. The connecting rods 16 convert the reciprocation of the pistons 10 into the rotational motion of the crankshaft 15.

The crankshaft 15 is provided with a ring gear 17. The ring gear 17 engages with a pinion gear 18 of a starter motor 7 that is activated when the engine 1 is started. The rotation of the ring gear 17 following the activation of the starter motor 7 cranks the engine 1.

A signal rotor 19 having a plurality of protrusions (teeth) 19*a* on the outer circumferential surface thereof is attached to the crankshaft 15. A crank position sensor 35 is disposed beside the signal rotor 19. The crank position sensor 35, which is an electromagnetic pick-up, for example, generates pulse-like signals (output pulses) corresponding to the protrusions 19*a* of the signal rotor 19 when the crankshaft 15 rotates.

The combustion chamber 1*a* of the engine 1 is provided with an ignition plug 3 for each of the cylinders #1 to #6. An igniter 4 controls the ignition timing of the ignition plugs 3. The engine 1 is provided with a water temperature sensor 31 for detecting a temperature of coolant (coolant temperature) circulating through a water jacket 1*b*.

Air intake passages 11 and exhaust passages 12 are connected to the combustion chambers 1*a* of the engine 1. Air intake valves 13 are placed between the air intake passages 11 and the combustion chambers 1*a*. Opening and closing operations of the air intake valves 13 cause the air intake passages 11 and the combustion chambers 1*a* to communicate with and to be cut off from each other. Exhaust valves 14 are placed between the exhaust passages 12 and the combustion chambers 1*a*. Opening and closing operations of the exhaust valves 14 cause the exhaust passages 12 and the combustion chambers 1*a* to communicate with and to be cut off from each other. The opening and closing operations of the air intake valves 13 and the exhaust valves 14 are carried out by the rotation of an intake camshaft 21 and an exhaust camshaft 22 to which the rotation of the crankshaft 15 is transmitted.

The intake camshaft 21 is provided with a VVT mechanism 23 for changing valve timing (open/close timing) of the air intake valves 13 by changing the relative rotational phase of the intake camshaft 21 with respect to the rotational phase of the crankshaft 15.

A cam position sensor 36 for identifying each cylinder is placed near the intake camshaft 21. The cam position sensor 36 is an electromagnetic pick-up, for example. Although not shown, the cam position sensor 36 is placed so as to face a protrusion (tooth) on the outer circumferential surface of a rotor integrated with the intake camshaft 21. The cam position sensor 36 outputs pulse-like signals when the intake camshaft 21 rotates. Because the intake camshaft 21 rotates at half the rotational speed of the crankshaft 15, the cam position sensor 36 generates a pulse-like signal (output pulse) every time the crankshaft 15 rotates 720 degrees.

A throttle valve 5 for regulating the air intake of the engine 1 is disposed upstream of the air intake passage 11. A throttle motor 6 drives the throttle valve 5. A throttle position sensor 34 detects the opening degree of the throttle valve 5. A vacuum sensor 32 for detecting pressure (suction pressure) in the air intake passage 11 is placed in the air intake passage 11, downstream of the throttle valve 5. A three-way catalyst 8 is placed in the exhaust passage 12 of the engine 1.

In the engine 1, an injector (fuel injection valve) 2 for directly injecting the fuel into the combustion chamber 1*a* is provided for each of the cylinders #1 to #6. High-pressure fuel is supplied to the injectors 2 of the cylinders by fuel supply equipment (not shown), and the fuel is directly injected into the combustion chambers 1*a* via the injectors 2. Thereafter, a mixture of air and fuel is formed in the combustion chambers 1*a*, ignited by the ignition plugs 3, and thus burned in the combustion chambers 1*a*. The combustion of the mixture in the combustion chambers 1*a* causes the pistons 10 to reciprocate, which causes the crankshaft 15 to rotate.

The operational state of the engine 1 as described above is controlled by an ECU (Electronic Control Unit) 100.

ECU

Figure 2:
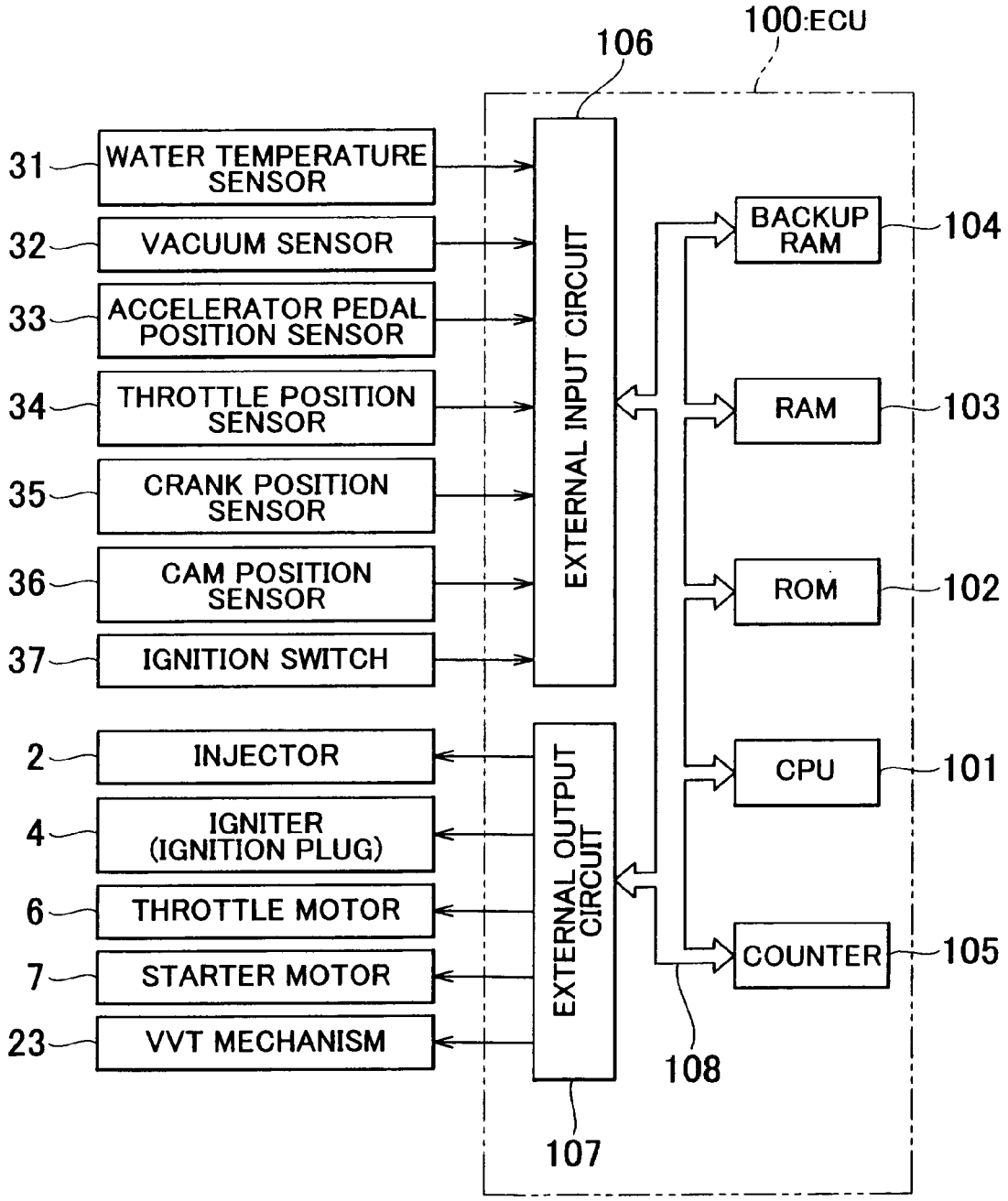
FIG. 2 is a block diagram showing a configuration of a control system including an ECU etc.

As shown in FIG. 2, the ECU 100 includes a CPU 101, a ROM 102, a RAM 103, a backup RAM 104, and a counter 105 for counting the number of times of fuel injection during the ignition cut operation, which will be described later.

Various control programs, maps that are referred to when the various control programs are executed, and the like are stored in the ROM 102. The CPU 101 performs processing, based on the various control programs and the maps stored in the ROM 102. The RAM 103 is a memory that temporarily stores, for example, calculation results outputted from the CPU 101, and the data supplied from the sensors. The backup RAM 104 is a nonvolatile memory that stores the data to be stored when the engine 1 is stopped. The ROM 102, the CPU 101, the RAM 103, the backup RAM 104, and the counter 105 are connected to one another via a bus 108, and are also connected to an external input circuit 106 and an external output circuit 107.

The water temperature sensor 31, the vacuum sensor 32, an accelerator pedal position sensor 33, the throttle position sensor 34, the crank position sensor 35, the cam position sensor 36, and an ignition switch 37 are connected to the external input circuit 106. The injectors 2, the igniter 4 of the ignition plugs 3, the throttle motors 6 of the throttle valves 5, the starter motor 7, and the VVT mechanism 23 are connected to the external output circuit 107.

The ECU 100 performs various control operations for the engine 1, based on the outputs from the various sensors including the water temperature sensor 31, the vacuum sensor 32, the accelerator pedal position sensor 33, the throttle position sensor 34, the crank position sensor 35, and the cam position sensor 36. In addition, the ECU 100 performs the engine start control under very low temperature conditions described below.

It should be noted that, in some cases, in order to inhibit the exhaust gas from containing soot when the engine is started under very low temperature conditions, the ECU 100 maximally advances valve timing of the air intake valves 13 (30 degrees CA) via the VVT mechanism 23, and performs control in which a large quantity of internal EGR gas is introduced into the combustion chambers 1*a*.

Engine Start Control Under Very Low Temperature Conditions

An example of the very-low-temperature engine-start control performed by the ECU 100 will be described with reference to a flow chart shown in FIG. 3A and FIG. 3B.

In step ST1, coolant temperature is read from the output from the water temperature sensor 31, and it is determined whether the engine is being started under very low temperature conditions, based on the coolant temperature. Specifically, if the coolant temperature is equal to or below a predetermined temperature (−25° C., for example) when the engine 1 is started, it is determined that the engine is being started under very low temperature conditions, and the process proceeds to step ST2. If the determination result in step ST1 is NO, this routine is exited.

In step ST2, it is determined whether elapsed time since start of the engine 1 is equal to or longer than a predetermined period of time (10 sec., for example), or whether the total amount of intake air since start of the engine 1 is equal to or greater than a predetermined amount (20 g, for example). If the determination result is YES, it is determined that the inside of the cylinders has been warmed up, and the process proceeds to step ST3. In step ST3, a cylinder-inside warming-up history flag is set to one. On the other hand, if the determination result is NO, it is determined that the inside of the cylinders has not been warmed up, and the process proceeds to step ST12. In step ST12, the cylinder-inside warming-up history flag is reset to zero. The wording "since start of the engine 1" in the conditions used in step ST2 means since the time point at which the engine 1 reaches a state where the engine 1 can operate in a self-sustaining manner.

In step ST2, the predetermined setting values for the elapsed time since start of the engine 1 and the total amount of intake air since start of the engine 1 are determined in consideration of the time and the total amount of intake air that are elapsed or reached by the time when the inside of the cylinders is warmed up after the engine is started, so that the state is reached where the inside of the cylinders has been warmed up to the extent that the fuel, of which the amount corresponds to that of the fuel injected at the time of normal operation, can be effectively used, and the engine can operate by the use of the fuel alone.

In step ST4, it is determined whether the request to start the engine has been made (whether the ignition switch has been turned on) after the engine is stopped. If the determination result is YES, the process proceeds to step ST5. If the determination result is NO, this routine is exited.

In step ST5, it is determined whether the coolant temperature measured at the time of engine startup under very low temperature conditions has decreased below the coolant temperature measured when the engine was stopped last time. If the determination result is NO, the process proceeds to step ST6. If the determination result is YES, the process proceeds to step ST12, and the cylinder-inside warming-up history flag is reset to zero.

The determination process in step ST5 is a process for determining whether the request to start the engine is made not immediately after the inside of the cylinders has been warmed up, but after a certain soak time (60 min., for example) has elapsed. If it is determined that the coolant temperature measured at the time of engine startup is slightly lower than the coolant temperature measured when the engine was stopped last time, that is, for example, if it is detected that the coolant temperature has decreased by at least a minimum quantity (for example, 1 lsb=0.657° C.) that the ECU 100 can recognize, it is judged that a certain soak time has elapsed, and the process proceeds to step ST6.

In step ST6, it is determined whether the coolant temperature measured at the time of engine restart is higher than the coolant temperature measured when the engine was stopped last time by a predetermined value or more. If the determination result is NO, the process proceeds to step ST7. If the determination result is YES, the process proceeds to step ST12, and the cylinder-inside warming-up history flag is reset to zero.

The determination process in step ST6 is a process for judging whether the request to restart the engine is made after a certain soak time (60 min., for example) has elapsed, as in the case of the process in step ST5. A reason for adding the process of step ST6 will be described below.

If used is only the condition, "the coolant temperature measured at the time of engine restart is lower than the coolant temperature measured when the engine was stopped last time," used in step ST5, it is impossible to identify the situation in which the coolant temperature measured at the time of engine startup is higher than the temperature measured when the engine was stopped last time due to the influence of the ambient temperature during the soak time. For example, this is the situation in which the coolant temperature measured when the engine is stopped last time is −30° C., and the engine 1 is started in the next morning when the coolant temperature is −25° C. because the ambient temperature measured at the time of engine startup in the next morning is higher than that measured on the previous day. Accordingly, in order to make it possible to identify the influence of change in the ambient temperature, the criterion, "the coolant temperature measured at the time of restart is higher than that measured when the engine is stopped last time," is set in step ST6.

A reason for setting the condition, "higher by a predetermined value or more," in step ST6 is as follows. That is, in some cases, the coolant temperature increases after the engine is stopped, due to hot soak or the like, and, therefore, the condition is set to avoid false judgment due to the increase in the coolant temperature. Specifically, by setting a condition, "higher by 5° C. or more," for example, the false judgment is avoided.

In step ST7, it is determined whether the cylinder-inside warming-up history flag F has been set to one at the time of engine restart. If the determination result is NO, that is, if there is no cylinder-inside warming-up history, cranking is performed, and ignition is cut off (ST8 and ST9). After cutting off the ignition is finished, the ignition is carried out (ST10 and ST11).

On the other hand, if the determination result in step ST8 is YES, that is, if there is a cylinder-inside warming-up history, cutting off the ignition is not carried out (the ignition cut operation is inhibited), cranking is performed, and ignition is carried out (ST13 and ST11).

In the above-described very-low-temperature engine-start control, concerning the number of times the ignition cut operation is to be performed in step ST9, fixed values of the number of times the ignition cut operation is to be performed may be stored, which are calculated from parameters, such as coolant temperature, the number of cranking revolutions, fuel-injection start time points, and fuel-injection end time points. Alternatively, the number of times the ignition cut operation is to be performed may be calculated each time the engine is started under very low temperature conditions, in the process in steps ST22 to ST25 of the flow chart shown in FIG. 4A.

According to the very-low-temperature engine-start control of this embodiment, when the inside of the cylinders is warmed up at the time of engine startup under very low temperature conditions, the cylinder-inside warming-up history flag is set, and, if the engine is started in a state where the cylinder-inside warming-up history flag has been set, that is, if the engine is started under very low temperature conditions in a state where the inside of the cylinders has been warmed up (the engine is restarted), cutting off of the ignition is inhibited. In this case, the fuel that can contribute to combustion is not increased in the cylinders, and it is possible to inhibit "wetting of ignitions plugs," and "smoldering of ignition plugs." In this way, it is possible to improve the startability.

Even in the case where the cylinder-inside warming-up history flag has been set, if the inside of the cylinders is cooled due to a long soak time, the cylinder-inside warming-up history flag is reset so that the ignition cut operation is performed at the time of engine startup under very low temperature conditions. In this way, it is possible to acquire the fuel that can contribute to combustion in the cylinders at the time of engine startup under very low temperature conditions, and therefore to achieve good startability.

Figure 3A:
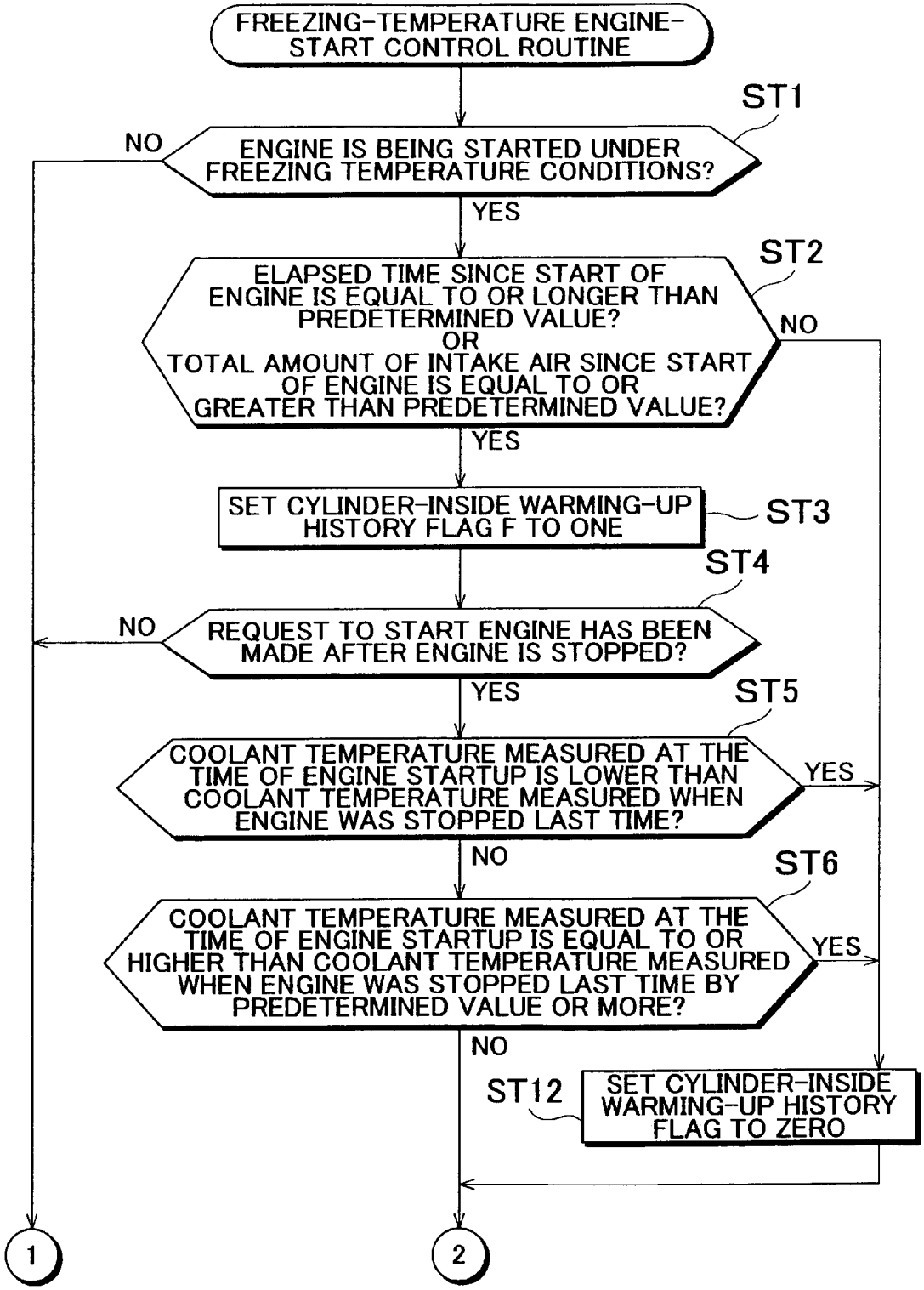
FIG. 3A and FIG. 3B are a flow chart showing an example of a process of very low temperature engine-start control performed by the ECU.

In this embodiment, if a soak timer for measuring the soak time is installed, a determination process for determining whether the soak time measured by the soak timer is equal to or longer than a predetermined period of time (60 min., for example) may be performed as a determination process for determining whether the inside of the cylinders has been cooled after the inside of the cylinders is warmed up, instead of the determination process in steps ST5 and ST6 shown in FIG. 3A.

Engine Start Control Under Very Low Temperature Conditions

Figure 4A:
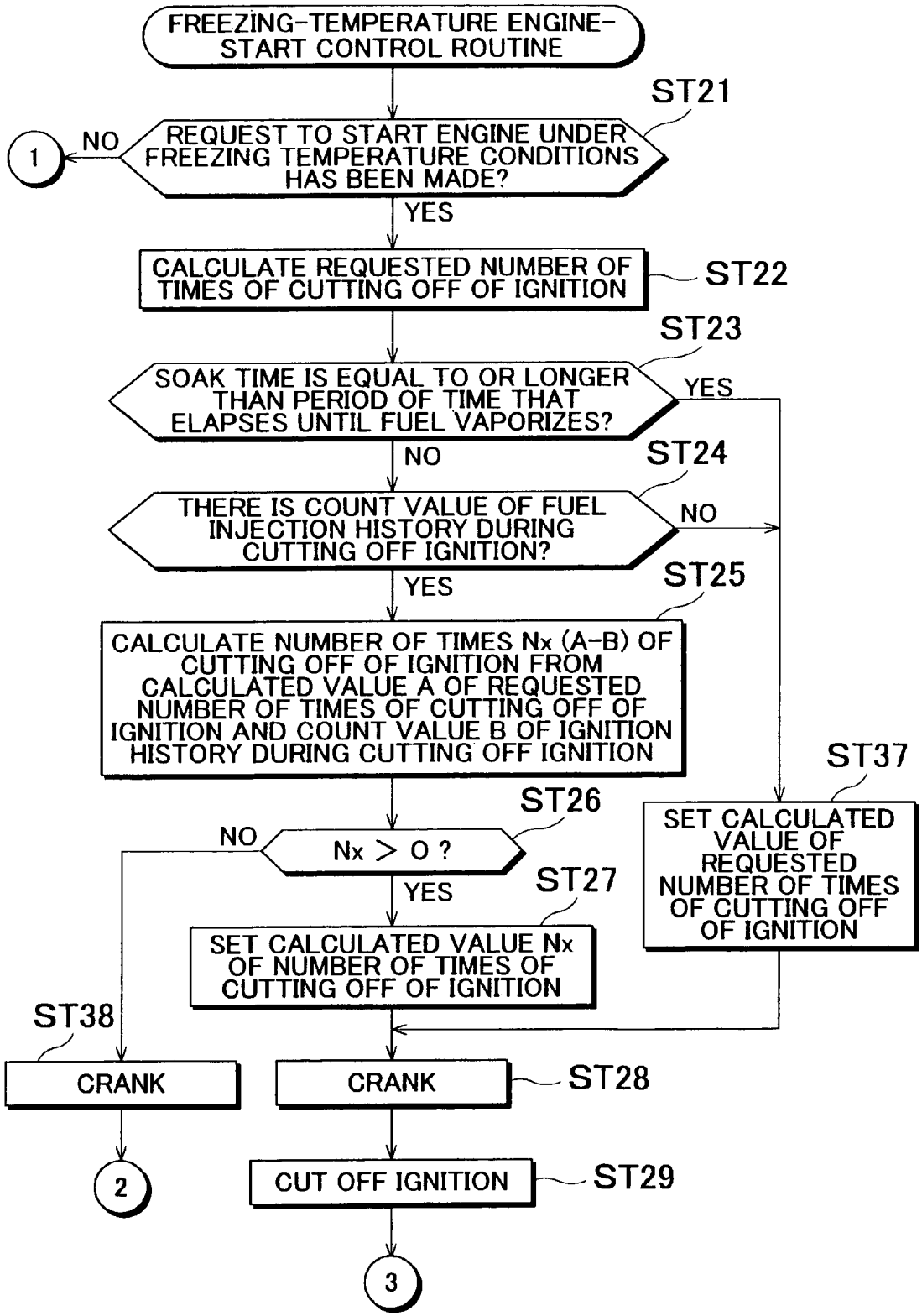
FIG. 4A and FIG. 4B are a flow chart showing another example of the process of very low temperature engine-start control performed by the ECU.
Figure 4B:
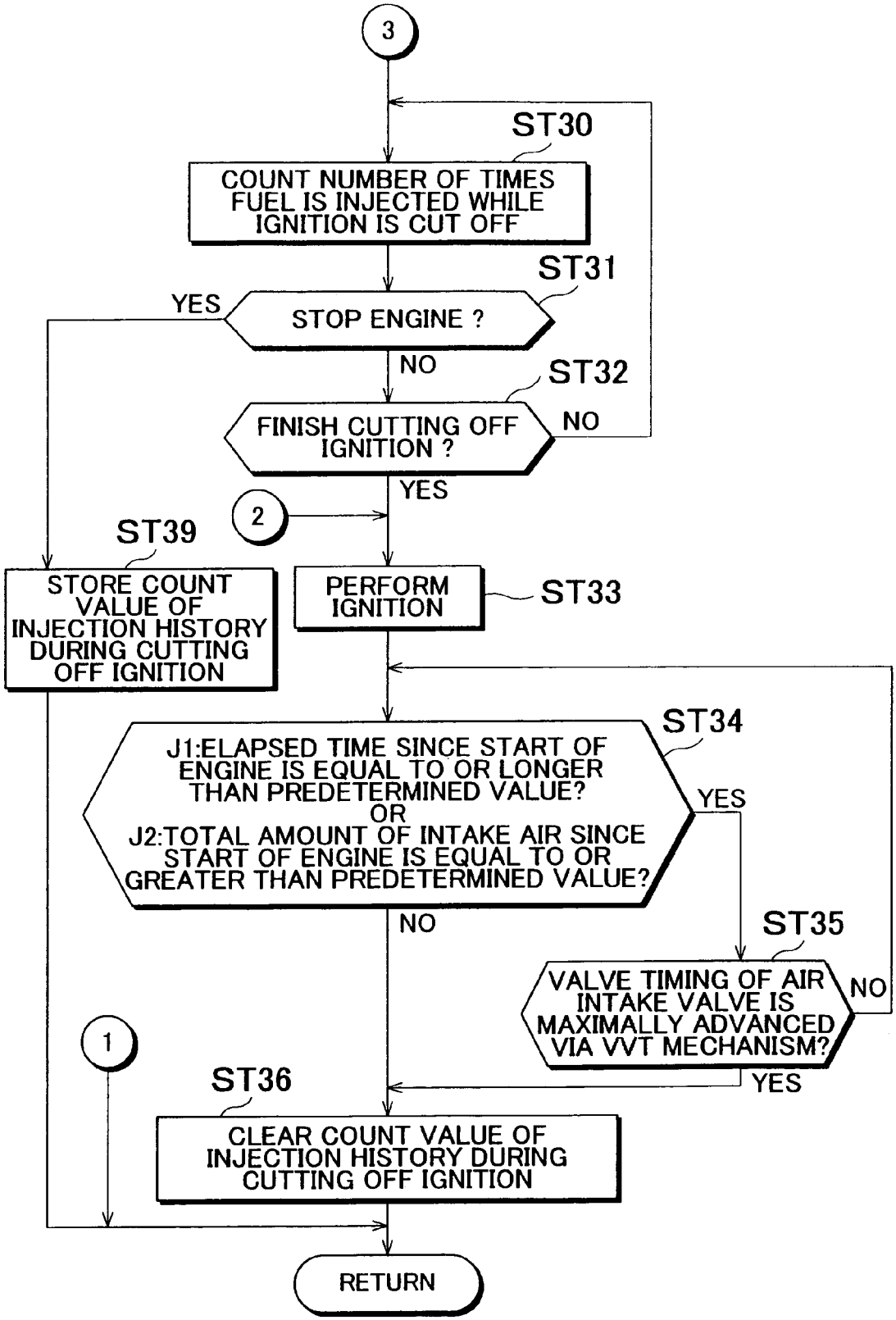

Another example of the very-low-temperature engine-start control performed by the ECU 100 will be described with reference to a flow chart shown in FIG. 4A and FIG. 4B.

In step ST21, coolant temperature is read from the output from the water temperature sensor 31, and it is determined whether request to start the engine under very low temperature conditions is being made, based on the coolant temperature. Specifically, if the coolant temperature is equal to or below a predetermined temperature (−25° C., for example) when the request to start the engine 1 is made (the ignition switch is turned on), it is determined that request to start the engine under very low temperature conditions is being made, and the process proceeds to step ST22. If the determination result in step ST21 is NO, this routine is exited.

In step ST22, the number of times of the ignition cut operation required during the ignition cut operation (hereinafter referred to as the requested number of times of cutting off of ignition) is calculated. The requested number of times of the ignition cut operation is calculated from a map, based on parameters, such as coolant temperature, the number of cranking revolutions, fuel-injection start time points, and fuel-injection end time points. In the case of a 6-cylinder engine, the requested number of times of the ignition cut operation is six (one-time injection for each cylinder), twelve (two-time injections for each cylinder), or eighteen (three-time injections for each cylinder), for example. In the description of this example, the requested number of times of the ignition cut operation is twelve.

Subsequently, in step ST23, it is determined whether the soak time is equal to or longer than a period of time (four hours, for example) required for the fuel in the cylinders of the engine 1 to vaporize. If the determination result is NO, the process proceeds to step ST24. If the determination result is YES, the process proceeds to step ST37.

In step ST24, it is determined whether there is a count value of the fuel-injection history during the ignition cut operation (hereinafter referred to as the injection history during the ignition cut operation). If there is a count value of the injection history during the ignition cut operation, the process proceeds to step ST25. If there is no count value of the injection history during the ignition cut operation, the process proceeds to step ST37.

In step ST25, the number of times the ignition cut operation is to be performed Nx (Nx=A−B) is calculated, using a calculated value A of the requested number of times of cutting off of ignition, which is obtained by the above calculation, and a count value B of the injection history during the ignition cut operation. If the count value B of the injection history during the ignition cut operation is "9," for example, the calculated value Nx of the number of times the ignition cut operation is to be performed Nx is "3."

Subsequently, in step ST26, it is determined whether the calculated value Nx of the number of times ignition is to be cut off is greater than zero. If the determination result is YES (Nx>0), the process proceeds to step ST27, and the setting of the calculated value Nx of the number of times the ignition cut operation is to be performed is adopted. If the determination result in step ST26 is NO (Nx=0), it is determined that the ignition cut operation has already been performed twelve times (fuel injection has already been performed twelve times), and the ignition cut operation is not performed (ignition cut operation is inhibited). In this case, cranking is started in step ST38, and the process then proceeds to step ST33.

On the other hand, If the determination result in step ST23 is YES, that is, if the soak time is equal to or longer than a period of time required for the fuel to vaporize, or if the determination result in step ST24 is NO, that is, if there is no count value of the injection history during the ignition cut operation, the setting of the calculated value A (A=12) of the requested number of times of cutting off of ignition, which is calculated in step ST22, is adopted.

After the calculated value is adopted as a setting, cranking is started (ST28), and the ignition cut operation is performed (ST29). At this time, the ignition cut operation is sequentially performed from the cylinder that is in an intake stroke (the cylinder #1, for example), based on the output from the crank position sensor 35 and the cam position sensor 36, and the number of times of fuel injection during the ignition cut operation is counted (ST30). The count value of the number of times of injection (the count value of the injection history during the ignition cut operation) is incremented each time fuel is injected into one cylinder.

Subsequently, in step ST31, it is determined whether the engine 1 is stopped (cranking is stopped) during the ignition cut operation. If the determination result is YES, the process proceeds to step ST39, and the count value of the number of times fuel injection has been performed by the time when the engine 1 is stopped, is stored. Thereafter, this routine is exited.

If the determination result in step ST31 is NO, that is, if the engine is not stopped while the ignition cut operation is performed, the process proceeds to step ST32, and it is determined whether the ignition cut operation is finished. Specifically, it is determined whether the count value of the injection history during the ignition cut operation has reached the calculated value Nx of the number of times the ignition cut operation is to be performed, or the calculated value A (A=12) of the requested number of times of cutting off of ignition. If the count value of the injection history during the ignition cut operation has not reached the calculated value Nx or the calculated value A yet (NO in step ST32), the process returns to step ST30. If the count value of the injection history during the ignition cut operation has reached the calculated value Nx or the calculated value A (YES in step ST32), the ignition cut operation is ended, and the engine 1 is started by performing ignition in the cylinders (ST33). The ignition in the cylinders is started from the cylinder (the cylinder #1, for example) in which two injections have been finished first. If the determination result in step ST26 described above is NO (Nx=0), ignition in the cylinders is performed, and the engine 1 is started without the ignition cut operation.

After the engine 1 is started, it is determined whether elapsed time since start of the engine is equal to or longer than a predetermined period of time (15 sec., for example) (J1), or whether the total amount of intake air since start of the engine is equal to or greater than a predetermined amount (25 g, for example) (J2), in step ST34. In step S35, it is determined whether valve timing of the air intake valves 13 is maximally advanced via the VVT mechanism 23 at the time of engine startup under very low temperature conditions.

If the determination result in step ST34 is YES, that is, if any one of the conditions J1 and J2 is satisfied, the process proceeds to step ST36, and the count value of the injection history during the ignition cut operation is cleared. Then, this routine is exited.

Even in the case where the determination result in step ST34 is NO, that is, even in the case where neither of the conditions J1 and J2 is satisfied, if the determination result in step ST35 is YES (that is, if valve timing of the air intake valves 13 is maximally advanced via the VVT mechanism 23 at the time of engine startup), it is determined that a large quantity of internal EGR gas has been introduced into the combustion chambers 1*a*, and the count value of the injection history during the ignition cut operation is cleared (ST36). Then, this routine is exited.

The determination process in step ST34 described above is a process for determining "whether there is no fuel that can contribute to combustion in the cylinders." A reason for adding the process of step ST34 will be described below.

In the case of engine startup under very low temperature conditions, fuel injected into the cylinders adheres to, for example, the top surface of the piston 10 at a low temperature. At an early stage after ignition is started, the adhering fuel remains unburned in the cylinders. However, when the engine speed is increased after the engine is started, the remaining fuel is burned, and completely consumed (that is, there is no fuel that can contribute to combustion in the cylinders). Under such conditions, it is necessary to perform fuel injection while ignition is cut off maximum times (which corresponds to the calculated value A of the requested number of times of cutting off of ignition). In order to realize this operation, the determination process of step ST34 is added. After the elapsed time since start of the engine under very low temperature conditions becomes equal to or longer than the predetermined period of time, or after the total amount of intake air since start of the engine under very low temperature conditions becomes equal to or greater than the predetermined amount, the count value of the injection history during the ignition cut operation is cleared to zero, and ignition is cut off maximum times (which corresponds to the calculated value A of the requested number of times of cutting off of ignition).

Figure 3B:
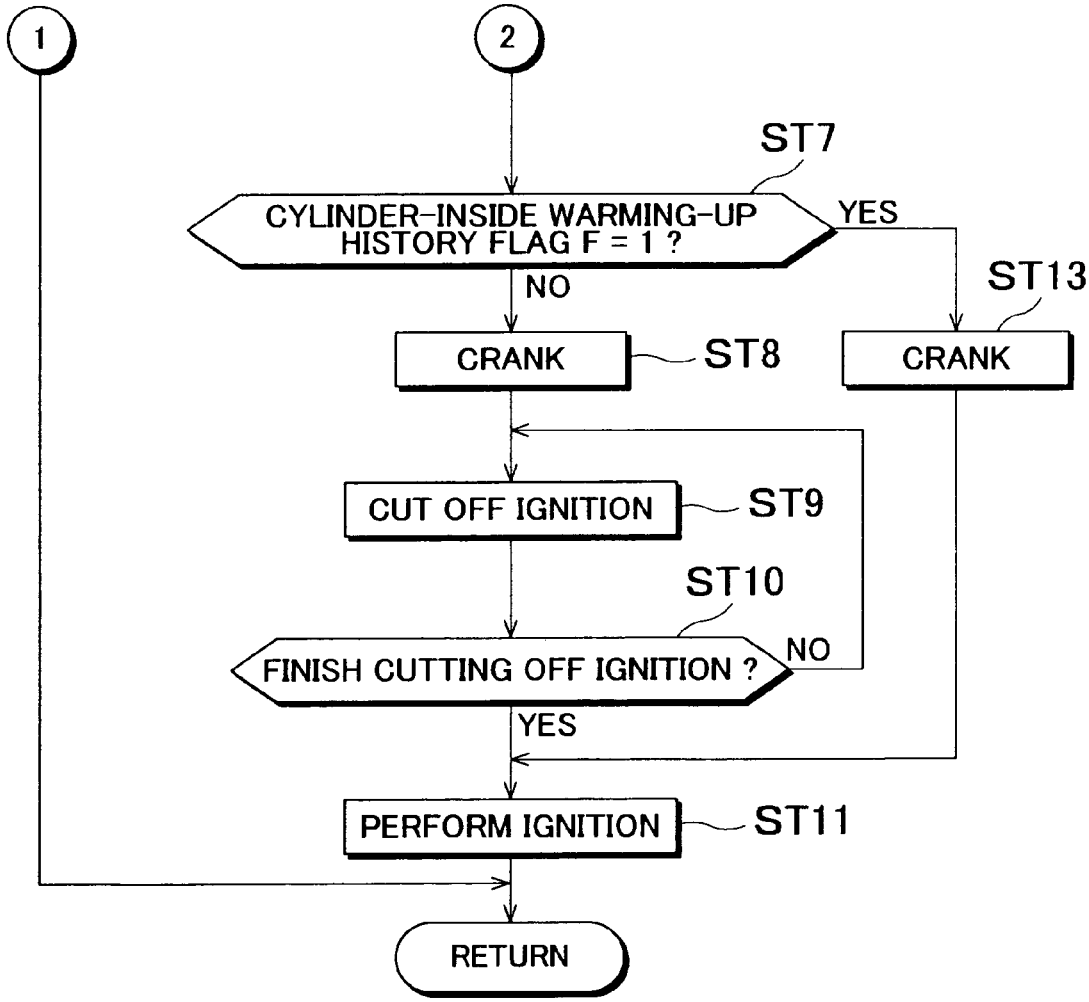

In this embodiment, if the engine 1 is stopped immediately after the engine 1 is started (that is, if the engine is stopped in a state where neither of the criteria set in step ST34 is satisfied), the ignition cut operation may be inhibited by a process similar to that of the very-low-temperature engine-start control shown in FIG. 3A and FIG. 3B.

The process in step ST35 is a process for determining "whether there is no fuel that can contribute to combustion in the cylinders," as in the case of the process in step ST34. A reason for adding the process of step ST35 will be described below.

With regard to a direct-injection gasoline engine provided with the VVT mechanism 23, in some cases, in order to inhibit the exhaust gas from containing soot when the engine is started under very low temperature conditions, control is performed in which valve timing of the air intake valves 13 is maximally advanced (30 degrees CA) via the VVT mechanism 23 to introduce a large quantity of internal EGR gas into the combustion chambers 1*a*; the time when this control is performed is not limited to when the engine is running at idle. Such introduction of internal EGR gas into the combustion chambers 1*a* causes the temperature in the combustion chambers 1*a* to increase, thereby promoting atomization of liquid fuel. In this way, even before one of the conditions used in step ST34 is satisfied, if valve timing of the air intake valves 13 is maximally advanced via the VVT mechanism 23, and a large quantity of internal EGR gas is thus introduced into the combustion chambers 1*a*, the fuel adhering to, for example, the top surface of the piston 10 immediately atomizes, and is burned and completely consumed. In consideration of this point, after the process of step ST35 is additionally performed, the count value of the injection history during the ignition cut operation is cleared.

Next, a concrete example of the above-described very-low-temperature engine-start control performed when the engine is restarted under very low temperature conditions after the engine is stopped during the ignition cut operation, will be described.

Figure 5:
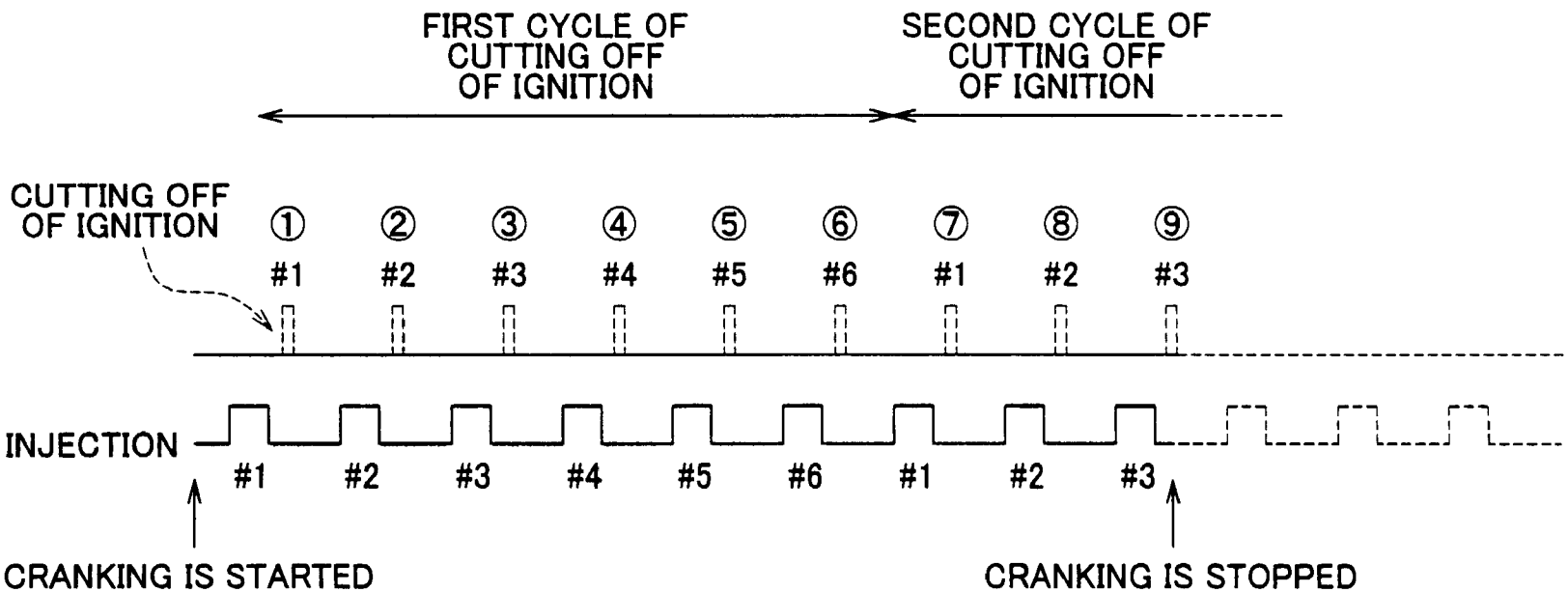
FIG. 5 is a diagram showing an example of the ignition cut operation performed when the engine is started under very low temperature conditions.

If the engine is started under very low temperature conditions for the first time, the count value of the injection history during the ignition cut operation is zero (the determination result in step ST24 is NO), and the setting of the calculated value A (A=12) of the number of times of the ignition cut operation is adopted in step ST37. Subsequently, the engine is cranked, and, at the same time, ignition is cut off (ST28, ST29). When the engine 1 is stopped (cranking is stopped) during the ignition cut operation, the ignition cut operation is also stopped. If ignition has been cut off nine times at the time when the ignition cut operation is stopped, fuel has been injected nine times during the ignition cut operation. As a result, the count value of the injection history during the ignition cut operation is nine, and the count value (nine) is stored (ST39). The count value "9" of the injection history during the ignition cut operation indicates the state where two-time (two-cycle) fuel injections have been completed for the cylinders #1 to #3, and where one-time (one-cycle) fuel injection has been completed for the cylinders #4 to #6, as shown in FIG. 5, for example.

In the case where, after the engine 1 is stopped during the ignition cut operation, the request to restart the engine under very low temperature conditions has been made, and where a period of time required for the fuel in the cylinders to vaporize has not elapsed yet (the determination result in step ST23 is NO), the current count value of the injection history during the ignition cut operation is nine, and the determination result in step ST24 is therefore YES. The number of times the ignition cut operation is to be performed Nx (Nx=A(12)−B(9)=3 times) is calculated, and the calculated value Nx is greater than zero (the determination result in step ST26 is YES). As a result, the setting of the calculated value Nx (Nx=3) of the number of times ignition is to be cut off is adopted in step ST27.

Thereafter, the engine 1 is cranked, and, after ignition is cut off three times during the cranking, ignition is performed (ST28, ST29). The ignition in the cylinders is started from the cylinder (the cylinder #1, for example) in which two-time injections have been finished first. Then, after the process in steps ST24 to ST36 is performed, this routine is exited.

When, during twelve-time cutting off of ignition, the engine 1 is stopped (cranking is stopped) at the time when ignition has been cut off nine times, that is, when fuel injection into the cylinder #3 in the second cycle is finished (see FIG. 5) as described above, in some cases, the crankshaft 15 rotates by inertia, and the crank position is shifted. In this case, there is a possibility that fuel injection into the cylinder #4, from which fuel injection in the second cycle should be started, is not performed. If ignition is cut off three times under such conditions, fuel injection is performed three times from the cylinder #5 with the cylinder #4 skipped. As a result, fuel injection into the cylinder #1 is performed three times. Thus, the fuel condition in the cylinder #1 becomes over-rich, and the possibility that "wetting of ignition plugs" and "smoldering of ignition plugs" occur becomes high.

If the fuel condition becomes over-rich in a cylinder, the number of times the ignition cut operation is to be performed is limited. Specifically, the crank position at which the engine 1 is stopped is stored, and the cylinder (cylinder #1) in which fuel will be injected three times is determined from the cylinder (cylinder #4) at which injection sequence is to be started, based on the stored crank position and a crank position in which the crank is when the engine 1 starts to move (when the crankshaft 15 starts to rotate). The ignition cut operation is not performed for such a cylinder (cylinder #1). If such a process is performed, only the first-cycle fuel injection during the ignition cut operation is performed in the cylinder #4. However, this is more advantageous than the case where the fuel condition in the cylinder #1 becomes over-rich, in view of achieving the object of improving the startability by inhibiting "wetting of ignition plugs" and "smoldering of ignition plugs."

According to the very-low-temperature engine-start control of this embodiment, if there is a fuel-injection history when the engine 1 is started (or restarted) under very low temperature conditions, the current number of times the ignition cut operation is to be performed Nx is calculated, using the requested number of times of the ignition cut operation and the number of times of injection recorded in the fuel-injection history during the ignition cut operation that was performed when it was attempted to start the engine last time. If the calculated value Nx is equal to or greater than one, the ignition cut operation is performed based on the calculated value Nx of the number of times the ignition cut operation is to be performed. In this way, the over-rich fuel condition is avoided even in the case where, after the engine is stopped during the ignition cut operation, the engine is restarted under very low temperature conditions. Thus, the startability is improved.

In the engine-start control of this embodiment, the determination step ST35 is added, in consideration of the case where, when valve timing of the air intake valves 13 is maximally advanced via the VVT mechanism 23 at the time of engine startup under very low temperature conditions, a large quantity of internal EGR gas is introduced into the combustion chambers 1*a*, and, therefore, the fuel that can contribute to combustion is completely consumed in the cylinders. However, if valve timing of the air intake valves 13 is not maximally advanced via the VVT mechanism 23, or if the VVT mechanism 23 is not installed, the determination process of step ST35 may be omitted.

In the above description, the embodiments are illustrated in which the present invention is applied to direct-injection 6-cylinder gasoline engines. However, the applications of the present invention are not limited to such engines. The present invention can also be applied to direct-injection gasoline engines with an arbitrary number of cylinders, such as direct-injection 4-cylinder gasoline engines.

What is claimed is:

1. A controller for a direct-injection internal combustion engine in which fuel is directly injected into a combustion chamber via a fuel injection valve, and a mixture formed thereby is burned by igniting the mixture via an ignition plug, wherein when the internal combustion engine is started under very low temperature conditions, the controller controls an ignition cut operation that inhibits ignition and performs fuel injection only, the controller comprising:

an engine-start control unit, wherein when the internal combustion engine is started under the very low temperature conditions after the ignition cut operation was performed, the engine-start control unit determines, based on (1) whether an elapsed time since a start of the internal combustion engine under the very low temperature conditions becomes equal to or longer than a predetermined period of time or (2) a total amount of intake air since a start of the internal combustion engine becomes equal to or greater than a predetermined amount, whether there is a cylinder-inside warming-up history, and, unless a predetermined cancellation condition is satisfied when there is the cylinder-inside warming-up history, the engine-start control unit inhibits the ignition cut, or limits a number of times the ignition cut operation is to be performed.

2. The controller for a direct-injection internal combustion engine according to claim 1, wherein if there is the cylinder-inside warming-up history, the engine-start control unit determines that there is fuel that can contribute to combustion in the cylinder.

3. The controller for a direct-injection internal combustion engine according to claim 2, wherein the cancellation condition is one of following conditions:

(i) a coolant temperature measured when the internal combustion engine is started under the very low temperature conditions is lower than a coolant temperature measured when the internal combustion engine was stopped last time; and (ii) the coolant temperature measured when the internal combustion engine is started under the very low temperature conditions is higher by a predetermined value or more than a coolant temperature measured when the internal combustion engine was stopped last time, and wherein, when one of the conditions is satisfied, the engine-start control unit cancels the inhibition of the ignition cut operation.

4. The controller for a direct-injection internal combustion engine according to claim 2, wherein the cancellation condition is that a soak time which has been elapsed by the time when the internal combustion engine is started under the very low temperature conditions is equal to or longer than a predetermined period of time, and wherein, when the condition is satisfied, the engine-start control unit cancels the inhibition of the ignition cut operation.

5. The controller for a direct-injection internal combustion engine according to claim 1, wherein, when the internal combustion engine is started under the very low temperature conditions, the engine-start control unit determines whether there is a fuel-injection history during the ignition cut operation, and, if there is the fuel-injection history during the ignition cut operation, the engine-start control unit determines that there is fuel that can contribute to combustion in the cylinder, and limits the number of times the ignition cut operation is to be performed, or inhibits the ignition cut operation.

6. The controller for a direct-injection internal combustion engine according to claim 5, wherein, when the internal combustion engine is started under the very low temperature conditions, if a soak time is equal to or longer than a period of time required for the fuel in the cylinder to vaporize, the engine-start control unit performs the ignition cut operation the number of times corresponding to the requested number of times of the ignition cut operation based on at least one of the coolant temperature, a number of cranking revolutions, fuel-injection start time points and fuel-injection end time points.

7. The controller for a direct-injection internal combustion engine according to claim 5, wherein, when the internal combustion engine is started under the very low temperature conditions, if there is the fuel-injection history during the ignition cut operation, the engine-start control unit calculates a current number of times the ignition cut operation is to be performed, using a requested number of times of the ignition cut operation based on a coolant temperature of the internal combustion engine and using a number of times of fuel injection during the ignition cut operation that was performed when it was attempted to start the engine last time, and, if the calculated value of the number of times the ignition cut operation is to be performed is equal to or greater than one, the engine-start control unit performs the ignition cut operation based on the calculated value, or, if the calculated value of the number of times the ignition cut operation is to be performed is equal to zero, the engine-start control unit does not perform the ignition cut operation.

8. The controller for a direct-injection internal combustion engine according to claim 7, wherein, when performing the ignition cut operation based on the calculated value of the number of times the ignition cut operation is to be performed, the engine-start control unit determines whether there is the cylinder for which the ignition cut operation is to be performed more times than the requested number of times of cutting off of ignition per cylinder, and the ignition cut operation is not performed for the cylinder for which the ignition cut operation is to be performed more times than the requested number of times of cutting off of ignition per cylinder.

9. The controller for a direct-injection internal combustion engine according to claim 7, wherein, when the elapsed time since start of the internal combustion engine under the very low temperature conditions becomes equal to or longer than a predetermined period of time, or when a total amount of intake air since start of the internal combustion engine under the very low temperature conditions becomes equal to or greater than a predetermined amount, the engine-start control unit resets the recorded number of times of fuel injection in the fuel-injection history during the ignition cut operation to zero.

10. The controller for a direct-injection internal combustion engine according to claim 7, wherein, when internal EGR gas is introduced into the cylinder when the internal combustion engine is started under the very low temperature conditions, the engine-start control unit resets the recorded number of times of fuel injection in the fuel-injection history during the ignition cut operation to zero.

11. A method of controlling a direct-injection internal combustion engine in which fuel is directly injected into a combustion chamber via a fuel injection valve, and a mixture formed thereby is burned by igniting the mixture via an ignition plug, wherein when the internal combustion engine is started under very low temperature conditions, the method controls an ignition cut operation that inhibits ignition and performs fuel injection only, the method comprising:

determining based on (1) whether an elapsed time since a start of the internal combustion engine under the very low temperature conditions becomes equal to or longer than a predetermined period of time or (2) a total amount of intake air since a start of the internal combustion engine becomes equal to or greater than a predetermined amount, whether there is a cylinder-inside warming-up history, and, unless a predetermined cancellation condition is satisfied when there is the cylinder-inside warming-up history inhibiting the ignition cut operation, or limiting a number of times the ignition cut operation is to be performed.

12. The method of controlling a direct-injection internal combustion engine according to claim 11, further comprising:

determining that if there is the cylinder-inside warming-up history, there is fuel that can contribute to combustion in the cylinder.

13. The method of controlling a direct-injection internal combustion engine according to claim 12, wherein the cancellation condition is one of following conditions:

(i) a coolant temperature measured when the internal combustion engine is started under the very low temperature conditions is lower than a coolant temperature measured when the internal combustion engine was stopped last time; and (ii) the coolant temperature measured when the internal combustion engine is started under the very low temperature conditions is higher by a predetermined value or more than a coolant temperature measured when the internal combustion engine was stopped last time, and the method further comprising:

canceling the inhibition of the ignition cut operation when one of the conditions is satisfied.

14. The method of controlling a direct-injection internal combustion engine according to claim 12, wherein the cancellation condition is that a soak time which has been elapsed by the time when the internal combustion engine is started under the very low temperature conditions is equal to or longer than a predetermined period of time, and the method further comprising:

canceling the inhibition of the ignition cut operation when the condition is satisfied.

15. The method of controlling a direct-injection internal combustion engine according to claim 11, further comprising:

determining whether there is a fuel-injection history during the ignition cut operation when the internal combustion engine is started under the very low temperature conditions; and, if there is the fuel-injection history during the ignition cut operation, determining that there is fuel that can contribute to combustion in the cylinder, and limiting the number of times the ignition cut operation is to be performed, or inhibiting the ignition cut operation.

16. The method of controlling a direct-injection internal combustion engine according to claim 15, wherein, when the internal combustion engine is started under the very low temperature conditions, if a soak time is equal to or longer than a period of time required for the fuel in the cylinder to vaporize, the ignition cut operation is performed the number of times corresponding to the requested number of times of the ignition cut operation based on at least one of the coolant temperature, a number of cranking revolutions, fuel-injection start time points and fuel-injection end time points.

17. The method of controlling a direct-injection internal combustion engine according to claim 15, wherein, when the internal combustion engine is started under the very low temperature conditions, if there is the fuel-injection history during the ignition cut operation, a current number of times the ignition cut operation is to be performed is calculated, using a requested number of times of the cutting off of ignition based on a coolant temperature of the internal combustion engine and using a number of times of fuel injection during the ignition cut operation that was performed when it was attempted to start the engine last time, and, if the calculated value of the number of times the ignition cut operation is to be performed is equal to or greater than one, the ignition cut operation is performed based on the calculated value, or, if the calculated value of the number of times the ignition cut operation is to be performed is equal to zero, the ignition cut operation is not performed.

18. The method of controlling a direct-injection internal combustion engine according to claim 17, wherein, when the ignition cut operation is performed based on the calculated value of the number of times the ignition cut operation is to be performed, it is determined whether there is the cylinder for which the ignition cut operation is to be performed more times than the requested number of times of cutting off of ignition per cylinder, and the ignition cut operation is not performed for the cylinder for which the ignition cut operation is to be performed more times than the requested number of times of cutting off of ignition per cylinder.

19. The method of controlling a direct-injection internal combustion engine according to claim 17, further comprising:

when the elapsed time since start of the internal combustion engine under very low temperature conditions becomes equal to or longer than a predetermined period of time, or when a total amount of intake air since start of the internal combustion engine under the very low temperature conditions becomes equal to or greater than a predetermined amount, resetting the recorded number of times of fuel injection in the fuel-injection history during the ignition cut operation to zero.

20. The method of controlling a direct-injection internal combustion engine according to claim 17, further comprising:

when internal EGR gas is introduced into the cylinder when the internal combustion engine is started under the very low temperature conditions, resetting the recorded number of times of fuel injection in the fuel-injection history during the ignition cut operation to zero.

* * * * *